US011300893B2

(12) United States Patent
Yoon et al.

(10) Patent No.: US 11,300,893 B2
(45) Date of Patent: Apr. 12, 2022

(54) TONER FOR DEVELOPING ELECTROSTATIC LATENT IMAGE

(71) Applicant: HEWLETT-PACKARD DEVELOPMENT COMPANY, L.P., Spring, TX (US)

(72) Inventors: Se Young Yoon, Seongnam-si (KR); Yo Da Shin, Seognam-si (KR); Woo Chui Jung, Seongnam-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/966,832

(22) PCT Filed: Jul. 26, 2018

(86) PCT No.: PCT/KR2018/008449
§ 371 (c)(1),
(2) Date: Jul. 31, 2020

(87) PCT Pub. No.: WO2019/151592
PCT Pub. Date: Aug. 8, 2019

(65) Prior Publication Data

US 2021/0041797 A1 Feb. 11, 2021

(30) Foreign Application Priority Data

Feb. 2, 2018 (KR) ..... 10-2018-0013618

(51) Int. Cl.
*G03G 9/08* (2006.01)
*G03G 9/097* (2006.01)
*G03G 15/08* (2006.01)

(52) U.S. Cl.
CPC ..... *G03G 9/09708* (2013.01); *G03G 9/0819* (2013.01); *G03G 15/0889* (2013.01)

(58) Field of Classification Search
CPC ..... G03G 9/09708
USPC ..... 430/108.1, 108.6
See application file for complete search history.

(56) References Cited

U.S. PATENT DOCUMENTS

| | | | | |
|---|---|---|---|---|
| 5,637,432 | A | 6/1997 | Okado et al. | |
| 10,394,151 | B2 * | 8/2019 | Tasaki | G03G 9/0819 |
| 2008/0056786 | A1 | 3/2008 | Ishino et al. | |
| 2011/0159427 | A1 | 6/2011 | Kang et al. | |
| 2013/0236824 | A1 | 9/2013 | Yoon et al. | |
| 2014/0234766 | A1 | 8/2014 | Yoon et al. | |
| 2017/0131648 | A1 | 5/2017 | Yoon et al. | |

FOREIGN PATENT DOCUMENTS

| | | | |
|---|---|---|---|
| EP | 2341395 | | 7/2011 |
| EP | 2767871 | | 8/2014 |
| JP | 2006-065317 | A | 3/2006 |
| JP | 2006-227189 | A | 8/2006 |
| JP | 2006-251074 | A | 9/2006 |
| KR | 1020110076192 | | 7/2011 |
| KR | 1020120075483 | A | 7/2012 |
| KR | 1020140103517 | A | 8/2014 |
| WO | WO-2013115413 | | 8/2013 |

* cited by examiner

*Primary Examiner* — Mark A Chapman
(74) *Attorney, Agent, or Firm* — Staas & Halsey LLP

(57) ABSTRACT

A toner for developing an electrostatic latent image includes a plurality of toner particles. Each of the plurality of toner particles includes an additive attached to a surface of the particle, such that, when the plurality of toner particles are measured by X-ray fluorescence (XRF) spectrometry, an X-ray fluorescence intensity of lanthanum [La] (unit: kcps) and an X-ray fluorescence intensity of strontium [Sr] (unit: kcps) measured by the XRF spectrometry of the toner satisfy the following conditions (1) and (2):

$$0.2\ \text{kcps} < [\text{La}] < 2\ \text{kcps} \quad (1),$$

and $$100\ \text{kcps} < [\text{Sr}] < 800\ \text{kcps} \quad (2).$$

14 Claims, No Drawings

TONER FOR DEVELOPING ELECTROSTATIC LATENT IMAGE

CROSS REFERENCE TO RELATED APPLICATIONS

This application is filed under 35 U.S.C. § 371 as a National Stage of PCT International Application No. PCT/KR2018/008449, filed on Jul. 26, 2018, in the Korean Intellectual Property Office, which claims the priority benefit of Korean Patent Application No. 10-2018-0013618, filed on Feb. 2, 2018, in the Korean Intellectual Property Office. The disclosures of PCT International Application No. PCT/KR2018/008449 and Korean Patent Application No. 10-2018-0013618 are incorporated by reference herein in their entireties.

TECHNICAL FIELD

In view of recent printers, for example, full-color printing, high-speed printing, high-quality image printing, compact size (lightweight), low printing costs, and environment-friendly printing, techniques of adjusting the shapes and surfaces of toner particles are becoming increasingly important to satisfy physical properties of toners for electrophotographic processes performed in printers.

BACKGROUND ART

The faster the printing speed of printers, the greater the number of times that shearing force is exerted on toner.

Surface characteristics of toner particles affect charging uniformity, charging stability, transferability, and cleaning ability to the toner particles. One of the factors affecting the surface characteristics of toner particles is an external additive added to surfaces of the toner particles. One of the functions of the external additive is to maintain fluidity of toner particles by preventing the toner particles from sticking together. The external additive may also affect charging uniformity, charging stability, transferability, and cleaning ability. As the external additive, silica particles or titanium oxide particles has been used.

DISCLOSURE OF INVENTION

Technical Problem

There is a need to increase durability of the toner. To realize compact and environment-friendly printers, the amount of "untransferred toner" needs to be reduced. To this end, there is a need to improve charge uniformity and transferability of the toner. To obtain a high-quality printed image, charging stability, transferability, and cleaning ability of the toner are needed to be improved.

Solution to Problem

Surface characteristics of toner particles affect charging uniformity, charging stability, transferability, and cleaning ability to the toner particles. One of the factors affecting the surface characteristics of toner particles is an external additive added to surfaces of the toner particles. One of the functions of the external additive is to maintain fluidity of toner particles by preventing the toner particles from sticking together. The external additive may also affect charging uniformity, charging stability, transferability, and cleaning ability. As the external additive, silica particles or titanium oxide particles has been used.

However, conventional external additives are known to be unfavorable in terms of obtaining charging uniformity. For example, fumed silica, which is the most widely used external additive in the art, has a very strong negative polarity. Thus, an excessive charge-up phenomenon may frequently occur in a toner that has fumed silica externally added thereto.

A method of externally adding titanium oxide particles, in addition to the fumed silica, to prevent excessive frictional charging due to the excessive charge-up phenomenon caused by the fumed silica has been tried. However, since titanium oxide has a low electric resistance and a good charge exchangeability, reverse or weak charged toner may be easily produced. Thus, when silica is externally added to the toner, charging uniformity of the toner may deteriorate.

Silica particles may be porous. In addition, silica particles may have hydrophilic surfaces. If toner that is externally added with silica particles having high porosity and highly hydrophilic surfaces is used in a high-temperature and high-humidity environment, such a toner may not be well charged due to excessive absorption of moisture, which serves as an electrical conductor. On the other hand, toner that is externally added with the silica particles is generally excessively charged in a low-temperature and low-humidity environment. That is, charging stability of toner externally added with the silica particles, which varies depending on the environment, may be deteriorated.

To address environmental charging stability degradation due to moisture, silica particles or titanium oxide particles that are surface-treated with a surface treating agent such as hydrophobic silicone oil or a hydrophobic silane coupling agent may be used as an external additive. However, if such external additive particles treated with such a surface treating agent are used, cohesiveness between toner particles increases, and thus, fluidity of toner may be rapidly degraded.

In a method of manufacturing fumed silica particles, aggregation of silica particles occurs frequently. The aggregation degrades dispersibility of the fumed silica particles. If an external additive with poor dispersibility is used, fluidity, anti-caking ability, fixability or fusability, and cleaning ability of toner obtained as a result may also be degraded.

Sol-gel silica may be used to avoid aggregation of fumed silica. Sol-gel silica particles refer to silica powder prepared by a sol-gel method. For example, sol-gel silica particles may be obtained by removing a solvent from a silica sol suspension obtained via hydrolysis and condensation of an alkoxysilane in an organic solvent in the presence of water, Sol-gel silica particles prepared by a sol-gel method include spherical silica particles having a uniform particle size. Conventional sol-gel silica particles have a nearly perfectly spherical shape. However, when silica particles having a sphericity of about 1 are used as an external additive, cleaning ability of the toner may deteriorate.

As described above, it may be challenging to improve all of charging uniformity, charging stability, transferability, and/or cleaning ability of a toner.

The present disclosure will now be described more fully with reference to the accompanying drawing in which like reference numerals refer to like elements throughout. In this regard, examples of the present disclosure may have different forms and should not be construed as being limited to the descriptions set forth herein. Accordingly, the examples are merely described below to explain examples. As used herein, the term "and/or" includes any and all combinations of one or more of the associated listed items.

According to an example of the present disclosure, a toner for developing electrostatic latent images including a plurality of toner particles is provided. Each of the toner particles includes a core particle including a binder resin, a colorant, and a releasing agent and an external additive attached to the surface of the core particle and including silica particles and lanthanum strontium titanate particles. An X-ray fluorescence intensity of lanthanum [La] (unit: kilocounts per second, hereinafter "kcps") and an X-ray fluorescence intensity of strontium [Sr] (unit: kcps) measured by X-ray fluorescence (XRF) spectrometry of the toner satisfy the following conditions (1) and (2) below:

$$0.2\ \text{kcps} < [La] < 2\ \text{kcps} \quad (1),$$

$$100\ \text{kcps} < [Sr] < 800\ \text{kcps} \quad (2).$$

In an example, the X-ray fluorescence intensity of lanthanum [La] of the toner, the X-ray fluorescence intensity of strontium [Sr] of the toner (unit: kcps), and an X-ray fluorescence intensity of silicon [Si] (unit: kcps) of the toner measured by XRF spectrometry may further satisfy conditions (3) and (4) below:

$$0.01 \leq [La]/[Si] \leq 0.04 \quad (3),$$

$$1 \leq [Sr]/[Si] \leq 20 \quad (4).$$

In an example, the silica particles may include a combination of large-diameter silica particles and small-diameter silica particles. A volume average particle diameter D50 of the large-diameter silica particles may be from about 50 nm to about 300 nm, and a volume average particle diameter D50 of the small-diameter silica particles may be from about 5 nm to about 50 nm. In this regard, the volume average particle diameter D50 refers to a diameter at which the cumulative volume of the silica particles corresponds to 50% of the total cumulative volume of the silica particles in a cumulative volume curve of the silica particles.

In an example, a volume average particle diameter D50 of the lanthanum strontium titanate particles may be from about 20 nm to about 100 nm. In this regard, the volume average particle diameter D50 refers to a diameter at which the cumulative volume of the lanthanum strontium titanate particles corresponds to 50% of the total cumulative volume of the lanthanum strontium titanate particles in a cumulative volume curve of the lanthanum strontium titanate particles.

According to another example of the present disclosure, a toner supply device employing the toner for developing an electrostatic latent image is also provided. Particularly, the toner supply device includes a toner tank storing the toner, a supplying part protruding toward an inner side of the toner tank and supplying the stored toner to an outside of the tank, and a toner stirring member rotatably installed in the toner tank and configured to stir in at least a portion of an inner space of the toner tank including an upper portion of the supplying part. The toner is a toner for developing an electrostatic latent image according to an example of the present disclosure.

According to another example of the present disclosure, an image forming apparatus employing the toner for developing an electrostatic latent image according to the present disclosure is provided. Particularly, the image forming apparatus includes an image carrier, an image forming device configured to form an electrostatic latent image on a surface of the image carrier, a toner storing device, a toner supply device configured to supply the toner to the surface of the image carrier to develop the electrostatic latent image as a visible image on the surface of the image carrier, and a transferring device configured to transfer the visible image from the surface of the image carrier to an image receiving member. The toner is a toner for developing an electrostatic latent image according to an example of the present disclosure.

According to another example of the present disclosure, a method of forming an image includes adhering a toner to a surface of an image carrier on which an electrostatic latent image is formed to form a visible image and transferring the visible image to an image receiving member. The toner is a toner for developing an electrostatic latent image according to the present disclosure.

The toner for developing an electrostatic latent image according to an example of the present disclosure includes a combination of sol-gel silica particles having appropriate particle diameters, hydrophobically surface-treated fumed silica particles, and hydrophobically surface-treated lanthanum strontium titanate ($LaSrTiO_3$) particles, as external additives, to satisfy conditions (1) and (2) above, if desired, all of conditions (1) to (4) above. Thus, surface characteristics of the toner may be modified by using the combination of the external additives without using $TiO_2$. By using the combination of the external additives, the toner for developing an electrostatic latent image according to the present disclosure may have the following effects.

First, the toner may have improved environmental charging stability due to a low difference in the amount of charge between high-temperature and high-humidity conditions and low-temperature and low-humidity conditions when compared with a conventional toner including only silica particles. The toner may also provide improved developing properties, transferring properties, photoreceptor background contamination inhibiting properties, and developing durability when compared with conventional toners. The toner may also have improved image characteristics over time such as improved image density retention property and charge retention property even after stored for a long period of time. Thus, the toner according to an example of the present disclosure may stably provide images of improved quality without using $TiO_2$ due to improved dot reproducibility regardless of environmental changes and the lapse of time.

BEST MODE FOR CARRYING OUT THE INVENTION

Hereinafter, the toner for developing an electrostatic latent image according to an example of the present disclosure will be described in detail.

The toner for developing an electrostatic latent image includes a plurality of toner particles. Each of the toner particles includes a core particle and an external additive attached to the surface of the core particle.

The core particle includes a binder resin, a colorant, and a releasing agent.

Examples of the binder resin may include, but are not limited to, a styrenic resin, an acrylic resin, a vinyl resin or polyolefin resin, a polyether-based polyol resin, a phenolic resin, a silicone resin, a polyester resin, an epoxy resin, a polyimide resin, a polyurethane resin, a polybutadiene resin, or any mixture thereof.

Examples of the styrenic resin may include, but are not limited to, polystyrene; a homopolymer of a styrenic monomer such as poly-p-chlorostyrene or polyvinyltoluene; a styrene-based copolymer such as a styrene-p-chlorostyrene copolymer, a styrenevinyltoluene copolymer, a styrene-vinyl naphthalene copolymer, a styrene-acrylic acid ester copolymer, a styrene-methacrylic acid ester copolymer, a styrene-methyl achloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, or a styrene-acrylonitrile-indene copolymer, or any mixture thereof.

Examples of the acrylic resin may include, but are not limited to, a polymer of acrylic acid, a polymer of methacrylic acid, a polymer of methyl methacrylate, a polymer of methyl α-chloromethacrylate, or any mixture thereof.

Examples of the vinyl resin or polyolefin resin may include, but are not limited to, polyvinyl chloride, polyethylene, polypropylene, polyacrylonitrile, polyvinyl acetate, or any mixture thereof.

The polyester resin may be prepared via reaction between an aliphatic, alicyclic, or aromatic polybasic carboxylic acid or alkyl ester thereof and polyhydric alcohol via direct esterification or trans-esterification. Examples of the polybasic carboxylic acid may include phthalic acid, isophthalic acid, terephthalic acid, tetrachlorophthalic acid, chlorophthalic acid, nitrophthalic acid, p-carboxyphenylacetic acid, p-phenylene-2-acetic acid, m-phenylenediglycolic acid, p-phenylenediglycolic acid, ophenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and/or cyclohexane dicarboxylic acid. Also, in addition to the dicarboxylic acid, a polybasic carboxylic acid such as trimellitic acid, pyromellitic acid, naphthalene tricarboxylic acid, naphthalene tetracarboxylic acid, pyrene tricarboxylic acid, and pyrene tetracarboxylic acid may be used. Also, derivatives of a carboxylic acid in which the carboxylic group thereof is reacted to form an anhydride, oxychloride, or ester group may be used. Among them, terephthalic acid or lower esters thereof, diphenyl acetic acid, cyclohexane di-carboxylic acid, or the like may be used. The lower ester refers to an ester of aliphatic alcohol having one to eight carbon atoms. Examples of the polyhydric alcohol may include an aliphatic diol such as ethylene glycol, diethylene glycol, triethylene glycol, propylene glycol, butane diol, hexane diol, neopentyl glycol, or glycerine; an alicyclic diol such as cyclohexane diol, cyclohexane dimethanol, or hydrogen-added bisphenol A; and an aromatic diol such as ethylene oxide adduct of bisphenol A or propylene oxide adduct of bisphenol A. One or more than one of the polyhydric alcohol may be used. Among these polyhydric alcohols, an aromatic diol and an alicyclic diol may be used. For example, an aromatic diol may be used. In addition, a polyhydric alcohol having three or more —OH groups, such as glycerin, trimethylol propane, or pentaerythritol may be used together with the diol to have a cross-linked structure or a branched structure to increase fixability or fusability of the toner.

A number average molecular weight of the binder resin may be in the range of about 700 to about 1,000,000 g/mol or about 10,000 to about 500,000 g/mol. The binder resin used in the present disclosure may include a combination of a high molecular weight binder resin and a low molecular weight binder resin in an appropriate ratio. A number average molecular weight of the high molecular weight binder resin may be, for example, from about 100,000 to about 500,000 g/mol, and a number average molecular weight of the low molecular weight binder resin may be, for example, from about 1,000 to about 100,000 g/mol. The two types of binder resins having different molecular weights may have independent functions. The low molecular weight binder resin has little molecular chain entanglements, thereby contributing to fusability and gloss. On the contrary, the high molecular weight binder resin may maintain a certain level of elasticity even at a high temperature due to many molecular chain entanglements, thereby contributing to anti-hot offset properties.

The colorant may be, for example, a black colorant, a yellow colorant, a magenta colorant, a cyan colorant, or any combination thereof.

For example, the black colorant may be carbon black, aniline black, or any mixture thereof.

For example, the yellow colorant may be a condensed nitrogen compound, an isoindolinon compound, an anthraquinone compound, an azo metal complex, an allyl imide compound, or any mixture thereof. More particularly, the yellow colorant may be, but is not limited to, "C.I. Pigment Yellow" 12, 13, 14, 17, 62, 74, 83, 93, 94, 95, 109, 110, 111, 128, 129, 147, 168, or 180.

For example, the magenta colorant may be a condensed nitrogen compound, an anthraquinone compound, a quinacridone compound, a base dye lake, a naphthol compound, a benzoimidazole compound, a thioindigo compound, a perylene compound, or any mixture thereof. More particularly, the magenta colorant may be, but is not limited to, "C.I. Pigment Red" 2, 3, 5, 6, 7, 23, 48:2, 48:3, 48:4, 57:1, 81:1, 122, 144, 146, 166, 169, 177, 184, 185, 202, 206, 220, 221, or 254.

For example, the cyan colorant may be a copper phthalocyanine compound or a derivative thereof, an anthraquinone compound, a base dye lake, or any mixture thereof. More particularly, the cyan colorant may be, but is not limited to, "C.I. Pigment Blue" 1, 7, 15, 15:1, 15:2, 15:3, 15:4, 60, 62, or 66.

The amount of the colorant included in the core particle may be, for example, from about 0.1 parts by weight to about 20 parts by weight, for example, from about 2 parts by weight to about 10 parts by weight, based on 100 parts by weight of the binder resin, without being limited thereto.

Examples of the releasing agent may include, but are not limited to, a polyethylene-based wax, a polypropylene-based wax, a silicone-based wax, a paraffin-based wax, an ester-based wax, a carnauba-based wax, a metallocene-based wax, or any mixture thereof.

The releasing agent may have, for example, a melting point of from about 50° C. to about 150° C., without being limited thereto. The amount of the releasing agent included in the core particle may be, for example, from about 1 part by weight to about 20 parts by weight, or from about 1 part by weight to about 10 parts by weight, based on 100 parts by weight of the binder resin. The releasing agent may prevent the toner particles from sticking to a heating roller of a fixing device.

The core particles may be prepared by, for example, a pulverization process, an aggregation process, or a spraying process. The pulverization process may be performed by, for example, pulverizing after melting and mixing a binder resin, a colorant, and a releasing agent. The aggregation process may be performed by, for example, mixing a binder resin dispersion, a colorant dispersion, and a releasing agent dispersion; aggregating these particles of the binder resin, the colorant, and the releasing agent; and combining the resulting aggregates.

A volume average particle diameter of the core particles may be, but is not limited to, from about 4 μm to about 20 μm or from about 5 μm to about 10 μm.

A shape of the core particles is also not particularly limited. As the shape of the core particles is closer to a sphere, charging stability of the toner and dot reproducibility of a print image may be more enhanced. For example, the core particles may have a sphericity in a range of, for example, about 0.90 to about 0.99.

External additives are attached to the surfaces of the core particles. One of the main functions of the external additives is to prevent the toner particles from sticking together thereby maintaining fluidity of toner powder. We have noted the behavior of external additives as one of the causes of a change in charge amount of the toner. Particularly, we have found that, if we use a combination of silica particles and lanthanum strontium titanate ($LaSrTiO_3$) particles as external additives of the toner, and adjust the X-ray fluorescence intensity of lanthanum [La] (unit: kcps), the X-ray fluorescence intensity of strontium [Sr] (unit: kcps), and the X-ray fluorescence intensity of silicon [Si] (unit: kcps) of the toner measured by X-ray fluorescence (XRF) spectrometry to satisfy the following conditions (1) and (2) below, if desired, all of conditions (1) to (4) below, then it improves environmental charging stability, developing properties, transferring properties, photoreceptor background contamination inhibiting properties, and developing durability:

$$0.2\ \text{kcps} < [La] < 2\ \text{kcps} \quad (1),$$

$$100\ \text{kcps} < [Sr] < 800\ \text{kcps} \quad (2),$$

$$0.01 \leq [La]/[Si] \leq 0.04 \quad (3),$$

and $$1 \leq [Sr]/[Si] \leq 20 \quad (4).$$

That is, surface characteristics of the toner for developing an electrostatic latent image according to an example of the present disclosure may be modified by using a combination of sol-gel silica particles having appropriate diameters, hydrophobically surface-treated fumed silica particles, and hydrophobically surface-treated lanthanum strontium titanate ($LaSrTiO_3$) particles, as external additives, to satisfy conditions (1) and (2) above, if desired, all of conditions (1) to (4) without using $TiO_2$.

Further, a toner for developing an electrostatic latent image an example of according to another example of the present disclosure may satisfy conditions (1') to (4') below.

$$0.5\ \text{kcps} \leq [La] \leq 1.5\ \text{kcps} \quad (1'),$$

$$200\ \text{kcps} \leq [Sr] \leq 750\ \text{kcps} \quad (2'),$$

$$0.01 \leq [La]/[Si] \leq 0.03 \quad (3'),$$

and $$5 \leq [Sr]/[Si] \leq 18 \quad (4').$$

By using the combination of the external additives, the toner for developing an electrostatic latent image according to an example of the present disclosure may have the following effects.

First, the toner may have improved environmental charging stability due to a low difference in charge amount between high-temperature and high-humidity conditions and low-temperature and low-humidity conditions when compared with conventional toners including only silica particles as an external additive. The toner may also provide improved developing properties, transferring properties, photoreceptor background contamination inhibiting properties, and developing durability when compared with conventional toners. The toner may also have improved image characteristics over time such as improved image density retention property and charge retention property even after a long term storage. Thus, the toner according to an example of the present disclosure may stably provide images of improved image quality without using $TiO_2$ due to improved dot reproducibility regardless of environmental changes and the lapse of time.

When the lanthanum strontium titanate ($LaSrTiO_3$) particles and silica particles are used as external additives such that the X-ray fluorescence intensity of lanthanum [La] (unit: kcps), the X-ray fluorescence intensity of strontium [Sr] (unit: kcps), and the X-ray fluorescence intensity of silicon [Si] (unit: kcps) of the toner measured by X-ray fluorescence (XRF) spectrometry satisfy the conditions (1) and (2) above, if desired, all of conditions (1) to (4) above, then the particles improve to maintain charging stability, developing properties, transferring properties, photoreceptor background contamination inhibiting properties, and developing durability at predetermined levels or higher for a long period of time. Thus, by using the toner, effects of appropriate and uniform concentration of toner, reduced background contamination, reduced contamination by scattered toner, and appropriate consumption of toner may be obtained.

As described above, the external additives including silica particles and lanthanum strontium titanate particles are attached to the surface of the core particles according to an example of the present disclosure.

The silica particles may be, for example, fumed silica, sol-gel silica, or a mixture thereof. When the primary particle size of the silica particles is too large, toner particles externally added therewith may be relatively difficult to pass through a developing blade. Accordingly, a selection phenomenon of toner may occur. That is, as a period of a toner cartridge having been used increases, a particle size of the toner particles remaining in the toner cartridge gradually increases. As a result, a quantity of charge of toner decreases and thus the thickness of a toner layer developing an electrostatic latent image increases. In addition, when the primary particle size of the silica particles is too large, a probability of the silica particles separating from the core particles may relatively increase due to stress applied to the toner particles from a member such as a feed roller. The separated silica particles may contaminate a charging member or a latent image carrier. On the other hand, when the primary particle size of the silica particles is too small, the silica particles are likely to be embedded into the core particles due to shearing stress of a developing blade that is applied to the toner particles. If the silica particles are embedded into the core particles, the silica particles lose their functionality as an external additive. Accordingly, adhesion between the toner particles and the surface of a photoconductor may be undesirably increased. This may lead to reduction in cleaning ability and transferability of the toner. For example, the silica particles may be small-diameter silica particles, for example, small-diameter fumed silica particles having a volume average particle diameter D50 of about 5 nm to less than about 50 nm, for example, about 5 nm to less than about 40 nm, about 5 nm to less than about 30 nm, or about 5 nm to less than about 20 nm. In this regard, the average particle diameter D50 refers to a diameter at which the cumulative volume of the silica particles corresponds to 50% of the total cumulative volume of the silica particles in a cumulative volume curve of the silica particles.

According to an example of the present disclosure, large-diameter silica particles may further be used to compensate drawbacks caused when using only the small-diameter silica particles. The large-diameter silica particles may be large-diameter silica particles, for example, large-diameter sol-gel silica particles, for example, monodispersed large-diameter sol-gel silica particles, having a volume average particle diameter D50 of about 50 nm to about 300 nm, about 50 nm to about 150 nm, about 50 nm to about 120 nm, about 50 nm to about 100 nm, or about 60 nm to about 80 nm. According to an example of the present disclosure, the silica particles may include a combination of large-diameter silica particles and small-diameter silica particles.

An amount of large-diameter silica particles may be from about 0.1 parts by weight to about 3 parts by weight, for example, from about 0.5 parts by weight to about 2.5 parts by weight, from about 1 part by weight to about 2.5 parts by weight, or from about 1 part by weight to about 2 parts by weight based on 100 parts by weight of the toner particles. An amount of small-diameter silica particles may be from about 0.1 parts by weight to about 2 parts by weight, for example, from about 0.5 parts by weight to about 1.5 parts by weight, from about 0.5 parts by weight to about 1.3 parts by weight, from about 0.5 parts by weight to about 1.1 parts by weight, or from about 0.5 parts by weight to about 1 part by weight based on 100 parts by weight of the toner particles.

When only the small-diameter silica particles are used, charging stability increases but the possibility that the silica particles are buried in the toner particles increases. When only the large-diameter silica particles are used, charging stability may deteriorate due to many voids on the surfaces of toner particles and the possibility that the silica particles are separated from the surfaces of the toner particles increases. To improve these properties, both the small-diameter silica particles and the large-diameter silica particles having different particle diameters may be used together. That is, the small-diameter silica particles may fill small voids between the large-diameter silica particles, thereby improving charging stability and preventing the silica particles from being buried in the toner particles. Accordingly, fluidity of the toner may be maintained even after a long term use, and thus image-quality retention property may be enhanced.

The small-diameter silica particles have high dispersibility. Silica particles tend to easily aggregates by surface treatment. Aggregation reduces the surface area of the external additive and thus the toner surface-treated with the aggregated silica particles may have a relatively low amount of the silica particles adhered to the surface of the toner particles. Thus, fluidity and charging stability of the toner may be improved by increasing dispersibility using silica particles having low aggregation. Particle diameter distribution of silica particles may be measured by using a particle size analyzer such as Horiba particle size analyzer. While conventional silica particles exhibit a unimodal particle size distribution, the silica aggregates may have an average diameter of about 5 μm to about 20 μm with a bimodal particle size distribution which has two peaks at about 1 μm or lower and at about 5 μm or higher in the toner according to an example of the present disclosure.

The large-diameter silica particles may reduce adhesiveness of the toner to a developing member and a transferring member, thereby improving developing properties and transferability. The large-diameter silica particles present in a monodisperse form may improve performance of the external additive and enhance durability of the toner by preventing the small-diameter silica particles from being separated from the toner particles and from being buried in the toner particles. By using the large-diameter silica particles having a higher specific gravity (i.e., lower porosity), environmental resistance of the toner to high-temperature and high-humidity and low-temperature and low-humidity environments may be improved. Particularly, under the high-temperature and high-humidity conditions, moisture may easily permeate into voids formed in the silica when the silica has a low specific gravity. In this case, as moisture has a relatively high electrical conductivity, charging performance of the toner may deteriorate. As a result, an image density increases, background contamination is worsened, the silica particles are easily detached, and thus durability of the toner may deteriorate. Thus, the large-diameter silica particles having a specific gravity of about 2 or more may be selected. As porosity of the silica particles decreases, the specific gravity of the silica particles may increase. Since the specific gravity of the silica particles is limited by an achievable low porosity, an upper limit of the specific gravity of the large-diameter silica particles is not particularly limited. The upper limit of the specific gravity of the large-diameter silica particles may be, for example, about 2.5.

The external additive attached to the surface of the toner may further include lanthanum strontium titanate particles in addition to the large-diameter and small-diameter silica particles. The lanthanum strontium titanate particles may improve developing properties, transferring properties, and charging stability in a high-temperature and high-humidity environment and a low-temperature and low-humidity environment of the toner by reducing a charge-up phenomenon.

A hydrophobic surface-treating agent used to hydrophobicize the small-diameter fumed silica particles and lanthanum strontium titanate particles may be, for example, silicone oils, silanes, siloxanes, or silazanes. Examples thereof include hexamethyldimethyl siloxane (HMDS), diethyldimethyl siloxane (DDS), and dimethyltrimethoxy silane (DTMS).

The small-diameter fumed silica particles and lanthanum strontium titanate particles may be hydrophobically surface-treated respectively and may have a degree of hydrophobicity of about 10% to about 90%, for example, about 30% or greater respectively. The large-diameter silica particles may or may not be treated with the hydrophobic surface-treating agent.

The lanthanum strontium titanate particles may have a volume average particle diameter D50 of about 5 nm to about 200 nm, for example, about 10 nm to about 150 nm, or about 20 nm to about 100 nm. In this regard, the average particle diameter D50 refers to a diameter at which the cumulative volume of the lanthanum strontium titanate particles corresponds to 50% of the total cumulative volume of the lanthanum strontium titanate particles in a cumulative volume curve of the lanthanum strontium titanate particles. An amount of the lanthanum strontium titanate particles may be from about 0.1 parts by weight to about 3 parts by weight, for example, from about 0.5 parts by weight to about 2.5 parts by weight, from about 1 parts by weight to about 2.5 parts by weight, or from about 1 part by weight to about 2 parts by weight based on 100 parts by weight of the toner particles.

The external additive particles may be attached to the surfaces of the core particles of the toner by using, for example, a powder mixing apparatus without being limited thereto. Examples of the powder mixing apparatus may be, but are not limited to a Henshell mixer, a V shape mixer, a ball mill, or a Nauta mixer.

The toner supply device according to another example of the present disclosure is a toner supply device including the toner for developing an electrostatic latent image according to an example of the present disclosure. For example, the toner supply device may include a toner tank to store a toner, a supplying part protruding toward an inner side of the toner tank and supplying the stored toner to an outside of the tank, and a toner stirring member rotatably installed inside the toner tank and configured to stir the toner in at least a portion of an inner space of the toner tank including an upper portion of the supplying part. The toner is a toner for developing an electrostatic latent image according to an example of the present disclosure.

The image forming apparatus according to another example of the present disclosure is an image forming apparatus including the toner for developing an electrostatic latent image according to an example of the present disclosure. For example, the image forming apparatus includes an image carrier, an image forming device configured to form an electrostatic latent image on a surface of the image carrier, a toner storage device, a toner supply device configured to supply the toner to the surface of the image carrier to thereby develop the electrostatic latent image as a visible image on the surface of the image carrier, and a transferring device configured to transfer the visible image from the surface of the image carrier to an image receiving member. The toner is a toner for developing an electrostatic latent image according to an example of the present disclosure.

The method of forming an image according to another example of the present disclosure includes forming a visible image by attaching a toner to a surface of an image carrier, e.g., an electrophotographic photoreceptor, on which an electrostatic latent image is formed, and transferring the visible image to an image receiving member, i.e., a transfer medium or a paper. The toner is a toner for developing an electrostatic latent image according to an example of the present disclosure. The method of forming an image may be electrophotography. An electrophotographic process generally includes a charging process to uniformly charge the surface of an electrostatic latent image carrier, an exposure process to form an electrostatic latent image by using various photoconductive materials on the charged electrostatic latent image carrier, a developing process to develop a visible image (e.g., a toner image) by attaching a developing agent such as a toner to the latent image, a transferring process to transfer the visible image onto a transfer medium such as paper, a cleaning process to remove toner that is not transferred and remains on the electrostatic latent image carrier, a charge eliminating process to remove charges remaining on the electrostatic latent image carrier, and a fixing or fusing process to fix the visible image by heat or pressure. In this regard, the toner according to an example of the present disclosure may be efficiently used for electrophotography.

Mode for the Invention

Hereinafter, the present disclosure will be described in more detail with reference to the following examples and comparative example. However, the present disclosure is not limited thereto.

Preparation of Sol-Gel Silica 60.3 g of ethanol, 5.5 g of distilled water, and 2.2 g of 28% ammonia solution were mixed and stirred for 10 minutes using a stirrer. The obtained solution was maintained at a temperature of 45° C. 143.1 g of tetraethoxy silane (TEOS, molecular weight: 208.33 g) was added dropwise thereto, and then 20.7 g of 28% ammonia solution and 50.3 g of distilled water were added dropwise thereto for 6 hours and 4 hours, respectively. After completion of dropwise addition, the mixture was stirred for 3 minutes to obtain sol-gel silica. Then, ethanol was distilled off by heating the mixture to obtain hydrophilic sol-gel silica. The obtained sol-gel silica has an average particle size (diameter) of about 70 nm. Then, 5 g of decyl trimethoxysilane (DTMS) was added to 10 g of the obtained silica to obtain hydrophobic sol-gel silica.

EXAMPLE

Hereinafter, % refers to % by weight unless otherwise noted.

Preparation Example 1

1. Preparation of L-Type Latex

A mixture of polymerizable monomers (825 g of styrene and 175 g of n-butyl acrylate), 30 g of (3-carboxyethyl acrylate (Sipomer, Rhodia), 17 g of 1-dodecanethiol as a chain transfer agent (CTA), and 418 g of an aqueous solution of sodium dodecyl sulfate (Aldrich, 2% in water) as an emulsifier were added to a 3 L beaker and the mixture was stirred to prepare a polymerizable monomer emulsion. 16 g of ammonium persulfate (APS) as an initiator and 696 g of an aqueous solution of sodium dodecyl sulfate (Aldrich, 0.4% in water) as an emulsifier were added to a 3 L double jacket reactor heated at about 75° C. The prepared polymerizable monomer emulsion was slowly added dropwise to the double jacket reactor for 2 hours or more while stirring. The mixture was maintained at about 75° C. for about 8 hours. Particles sizes of the prepared latex measured by a light scattering method (Mictotrac) were from about 180 nm to about 250 nm. A solid content of the latex measured by a dry weight loss method was about 42%. A weight average molecular weight (Mw) of the latex measured by gel permeation chromatography (GPC) using the portion of the latex that is soluble in tetrahydrofuran (THF) was about 25,000 g/mol. A glass transition temperature of the latex measured at a second scanning at a heating rate of 10° C./min by a DSC method (PerkinElmer) was about 62° C.

2. Preparation of H-Type Latex

A mixture of polymerizable monomers (685 g of styrene and 315 g of n-butyl acrylate), 30 g of β-carboxyethyl acrylate (Sipomer, Rhodia), and 418 g of an aqueous solution of sodium dodecyl sulfate (Aldrich, 2% in water) as an emulsifier were added to a 3 L beaker and the mixture was stirred to prepare a polymerizable monomer emulsion. 5 g of ammonium persulfate (APS) as an initiator and 696 g of an aqueous solution of sodium dodecyl sulfate (Aldrich, 0.4% in water) as an emulsifier were added to a 3 L double jacket reactor heated at about 60° C. The prepared polymerizable monomer emulsion was slowly added dropwise to the double jacket reactor for 3 hours or more while stirring. The mixture was maintained at about 75° C. for about 8 hours. Particles sizes of the prepared latex measured by a light scattering method (Horiba 910) were from about 180 nm to about 250 nm. A solid content of the latex measured by a dry weight loss method was about 42%. A weight average molecular weight (Mw) of the latex measured by gel permeation chromatography (GPC) using the portion of the latex that is soluble in tetrahydrofuran (THF) was about 25,000 g/mol. A glass transition temperature of the latex measured at a second scanning at a heating rate of 10° C./min by the DSC method (PerkinElmer) was about 53° C.

3. Preparation of Pigment Dispersion 10 g of sodium dodecyl sulfate as an anionic reactive emulsifier and 60 g of a carbon black pigment were added to a milling bath, and 400 g of glass beads having a diameter of about 0.8 mm to about 1 mm were added thereto. The mixture was milled at room temperature to prepare a dispersion. An ultrasonic homogenizer or a micro fluidizer may be used to disperse the mixture. Particle diameters of the pigment dispersion measured by a light scattering method (Horiba 910) were from about 180 nm to about 200 nm. A solid content of the prepared pigment dispersion was about 18.5%.

4. Preparation of Agglomerated Toner 3000 g of deionized water, 700 g of a latex mixture for core particles (a mixture of 95% of the L-type latex and 5% of the H-type latex), 195 g of the pigment dispersion, and 237 g of a wax dispersion (P787, Chukyo Yushi, Co., Ltd., Solid content: about 30.5%) were added to a 7 L reactor. A mixture of 364 g of nitric acid (0.3 mol) and 182 g of polysilicate indium (Aldrich) was added to the reactor and the mixture was stirred by using a homogenizer at about 11,000 rpm for 6 minutes, and then 417 g of the latex mixture was further added and the mixture was further stirred for 6 minutes to obtain agglomerates having a size of about 1.5 μm to about 2.5 μm.

The mixture was added to a 7 L double jacket reactor and heated from room temperature to a temperature of about 55° C. (Tg of the latex-5° C.) at a rate of 0.5° C./min. When the particle diameter D50 (Volume) reaches about 6.0 μm, 442 g of the latex mixture (a mixture of 90% of the L-type latex and 10% of the H-type latex) was slowly added thereto for about 20 minutes. When the particle diameter D50 (Volume) reaches about 6.8 μm, the pH of the mixture was adjusted to about 7 by adding 1 mol NaOH. When the particle diameter D50 (Volume) was maintained for 10 minutes, the reactor was heated to about 96° C. After the temperature reaches about 96° C., the pH was adjusted to about 6.0, coalescence was performed for 3 to 5 hours to obtain a secondary agglomerated toner with a potato shape having a particle diameter D50 (Volume) of about 6.5 μm to about 7.0 μm. Then, the agglomerated reaction solution was cooled below the glass transition temperature Tg and the toner particles were separated by filtration and dried.

Example 1: Preparation of Externally Added Toner

To externally add inorganic fine particles to surfaces of untreated dry toner particles, 100 parts by weight of the untreated toner particles were added to a mixer (manufactured by DAEWHA TECH IND., model name: KMLS2K), and then 2.0 parts by weight of sol-gel silica having a primary particle diameter of about 70 nm and an apparent density of about 220 g/L and satisfying the specifications shown in Table 1 below (SG50, Suckyoung), 1.0 part by weight of small-diameter fumed silica having a primary particle diameter of about 16 nm and hydrophobicized with diethyldimethyl siloxane (DDS) (AEROSIL®972, Evonik Industries), and 1.0 part by weight of lanthanum strontium titanate (SWL400B, Titan Industry Co., Ltd.) were further added to the mixer. The mixture was mixed in a 2 L stirrer at about 2000 rpm for 30 seconds and then further stirred at about 6000 rpm for 3 minutes to obtain externally added toner particles.

The toner particles thus obtained had a volume average particle diameter D50 (Volume) of about 6.5 μm to about 7.0 μm. The toner had a GSDp value of 1.282 and a GSDv value of 1.217. The toner particles had an average circularity of 0.971.

Examples 2 to 7 and Comparative Examples 1 to 6: Preparation of Externally Added Toner Toners according to Examples 2 to 7 and Comparative Examples 1 to 6 were prepared in the same manner as in Example 1, except that the types and/or amounts of the external additives, i.e., large-diameter spherical sol-gel silica particles, small-diameter silica particles, and lanthanum strontium titanate particles, were varied as shown in Table 2 below.

TABLE 1

| | Particle diameter(nm) | Surface area($m^2$/g) | Source (Product name) | Content(reference: 100 parts by weight of untreated particles of toner) |
|---|---|---|---|---|
| Large-diameter sol-gel silica particles | 70 | 50 | Suckyoung, Korea, (SG50) | 2.0 |
| Small-diametersilica particles | 16 | 130 | Evonik Industries, Germany (AEROSIL ®R972) | 1.0 |
| Lanthanum strontium titanate particles | 45 | 60 | Titan Industry Co. LTD, Japan(SWL400B) | 1.0 |

TABLE 2

| | Large-diameter spherical sol-gel silica particles | | | Small-diameter silica-particles | | | | Lanthanum strontium titanate particles | | | |
|---|---|---|---|---|---|---|---|---|---|---|---|
| | | | | | | Hydrophobic | | | | Hydrophobic | |
| | PD# (nm) | SA##($m^2$/g) | Amount(pbw###) | PD (nm) | SA($m^2$/g) | surface treating agent | Amount (pbw) | PD (nm) | SA($m^2$/g) | surface treating agent | Amount (pbw) |
| Example 1 | 70 | 50 | 2.0 | 16 | 130 | DDS* | 1.0 | 45 | 60 | HMDS**10% | 1.0 |
| Example 2 | 70 | 50 | 2.0 | 16 | 130 | DDS | 1.0 | 20 | 90 | HMDS 10% | 1.0 |

TABLE 2-continued

| | Large-diameter spherical sol-gel silica particles | | | Small-diameter silica-particles | | | | Lanthanum strontium titanate particles | | | |
|---|---|---|---|---|---|---|---|---|---|---|---|
| | PD# (nm) | SA##($m^2$/g) | Amount(pbw###) | PD (nm) | SA($m^2$/g) | Hydrophobic surface treating agent | Amount (pbw) | PD (nm) | SA($m^2$/g) | Hydrophobic surface treating agent | Amount (pbw) |
| Example 3 | 70 | 50 | 2.0 | 16 | 130 | DDS | 1.0 | 100 | 40 | HMDS 10% | 1.0 |
| Example 4 | 70 | 50 | 2.0 | 16 | 130 | DDS | 1.0 | 45 | 60 | HMDS 5% | 1.0 |
| Example 5 | 70 | 50 | 2.0 | 16 | 130 | DDS | 1.0 | 45 | 60 | HMDS 15% | 1.0 |
| Example 6 | 70 | 50 | 2.0 | 16 | 130 | DDS | 1.0 | 45 | 60 | HMDS 10% | 0.5 |
| Example 7 | 70 | 50 | 2.0 | 16 | 130 | DDS | 1.0 | 45 | 60 | HMDS 0% | 1.5 |
| CE#### 1 | 70 | 50 | 2.0 | 16 | 130 | DDS | 1.0 | 15 | 140 | HMDS 10% | 1.0 |
| CE2 | 70 | 50 | 2.0 | 16 | 130 | DDS | 1.0 | 120 | 30 | HMDS 10% | 1.0 |
| CE3 | 70 | 50 | 2.0 | 16 | 130 | DDS | 1.0 | 45 | 60 | HMDS 0% | 1.0 |
| CE4 | 70 | 50 | 2.0 | 16 | 130 | DDS | 1.0 | 45 | 60 | HMDS 20% | 1.0 |
| CE5 | 70 | 50 | 2.0 | 16 | 130 | DDS | 1.0 | 45 | 60 | HMDS 10% | 0.2 |
| CE6 | 70 | 50 | 2.0 | 16 | 130 | DDS | 1.0 | 45 | 60 | HMDS 10% | 2.0 |

#PD: Particle diameter
SA: surface area
pbw: parts by weight
CE: Comparative Example
*DDS: diethyldimethyl siloxane
**HMDS: hexamethyldimethyl siloxane Physical properties of the toners prepared according to Examples 1 to 7 and Comparative Examples 1 to 6 are shown in Table 3 below.

TABLE 3

| Examples | [La]Intensity* | [Si]Intensity | [Sr]Intensity** | [La]/[Si]value | [Sr]/[Si] value | ECS*** | Transfer-ability | DP | PBC | DD |
|---|---|---|---|---|---|---|---|---|---|---|
| Example 1 | 1.0 | 48 | 500 | 0.02 | 10.42 | ◎ | ◎ | ◎ | ◎ | ◎ |
| Example 2 | 1.0 | 48 | 500 | 0.02 | 10.42 | ◎ | ○ | ◎ | ◎ | ◎ |
| Example 3 | 1.0 | 48 | 500 | 0.02 | 10.42 | ◎ | ◎ | ◎ | ○ | ◎ |
| Example 4 | 1.0 | 48 | 500 | 0.02 | 10.42 | ○ | ◎ | ◎ | ○ | ○ |
| Example 5 | 1.0 | 48 | 500 | 0.02 | 10.42 | ◎ | ◎ | ○ | ◎ | ○ |
| Example 6 | 0.5 | 48 | 250 | 0.01 | 5.21 | ○ | ○ | ○ | ◎ | ○ |
| Example 7 | 1.5 | 48 | 750 | 0.03 | 15.63 | ○ | ◎ | ○ | ◎ | ○ |
| CE1 | 1.0 | 48 | 500 | 0.02 | 10.42 | Δ | Δ | Δ | ○ | Δ |
| CE2 | 1.0 | 48 | 500 | 0.02 | 10.42 | Δ | ◎ | ◎ | X | ○ |
| CE3 | 1.0 | 48 | 500 | 0.02 | 10.42 | X | ○ | ○ | Δ | Δ |
| CE4 | 1.0 | 48 | 500 | 0.02 | 10.42 | ○ | Δ | Δ | ◎ | ○ |
| CE5 | 0.2 | 48 | 100 | 0.004 | 2.08 | X | X | X | ○ | X |
| CE6 | 2.0 | 48 | 1000 | 0.04 | 20.83 | ◎ | ◎ | ◎ | Δ | X |

*XRF intensity of $La_2O_3$, which is an oxide form of La (unit: kilocounts per second (kcps)) and is proportional to concentration of La included in the toner.
**XRF intensity of SrO, which is an oxide form of Sr, (unit: kcps) and is proportional to concentration of Sr included in the toner.
***ECS: Environmental Charging Stability
DP: Developing Property
PBC: Photoreceptor Background Contamination
DD: Developing Durability Properties of the toners prepared according to Examples 1 to 7 and Comparative Examples 1 to 6 shown in Table 3 were evaluation results performed by the following tests.

Evaluation Methods

Measurement of [La]Intensity, [Sr]Intensity, [La]/[Si] Intensity Ratio, and [Sr]/[Si]Intensity Ratio Lanthanum XRF intensity [La], strontium XRF intensity [Sr], and silicon XRF intensity [Si] of the toners were measured by X-ray fluorescence (XRF) spectrometry according to the following procedure.

First, 3 g±0.01 g of a toner sample was compression-molded under conditions of a load of 2 ton and a compression time of 10 seconds by using a compression molder. Lanthanum XRF intensity [La], strontium XRF intensity [Sr], and silicon XRF intensity [Si] (unit: kcps) were measured from fluorescent X-rays generated from the toner sample by using an energy dispersive X-Ray spectrometer (model no.: EDX 720, SHIMADZU Corporation). The intensities are indicators indicating contents of lanthanum, strontium, and silicon of each toner. A [La]/[Si] XRF intensity ratio and a [Sr]/[Si] XRF intensity ratio were calculated from the values. Measurement conditions include a tube voltage of 50 kV and a tube current of 23 μA.

Subsequently, the following experiments were conducted to evaluate properties of the toners of Examples 1 to 7 and Comparative Examples 1 to 6.

Images were printed up to 5,000 sheets of paper at a coverage rate of 1% using one-component developing type printer (CLP 680, Samsung Electronics) to evaluate developing properties, transferring properties, image density, image contamination, and changes in properties over time (changes in the toner layer on a developing roller and changes in image density according to the number of prints) according to printing conditions.

Environmental Charging Stability

Evaluation was performed by using an EPPING q/m meter as a measuring device under the conditions of a voltage of 105 V and an air flow rate of 2.0 L/min according to the following procedure.

0.5 g of a toner and 9.5 g of a carrier were added to a 200 cc bottle and mixed using a TURBULAR mixer for about 3 minutes to prepare a toner sample. The toner sample was maintained under a low-temperature and low-humidity (LL) condition (10° C., relative humidity of 10%) and a high-temperature and high-humidity (HH) condition (30° C., relative humidity of 80%) respectively. Then, charging performance thereof was evaluated to measure charge amount in each environment and charging stability was evaluated according to the following criteria.

◎: Charge amount ratio of HH/LL of 0.9 to 1.0 (Excellent state in which almost no difference between charge amounts in different environmental conditions was found)

○: Charge amount ratio HH/LL of 0.8 to less than 0.9 (Good state in which a little difference between charge amounts in different environmental conditions was found)

Δ: Charge amount ratio of HH/LL of 0.7 to less than 0.8 (State in which a large difference between charge amounts in different environmental conditions was found)

X: Charge amount ratio of HH/LL of less than 0.7 (State in which a very large difference between charge amounts in different environmental conditions was found)

Developing Property

After printing 1,000 sheets of paper, After printing 1,000 sheets of paper, an image with a certain area was developed on an electrophotographic photoreceptor before the toner was transferred to an intermediate transfer member from the electrophotographic photoreceptor, and the weight of the toner per unit area of the electrophotographic photoreceptor was measured using a suction device equipped with a filter. In this regard, the weight of the toner per unit area on a developing roller was simultaneously measured and developing property was evaluated using the following method.

Developing efficiency=Weight of toner per unit area of electrophotographic photoreceptor/weight of toner per unit area of developing roller×100 (%)

◎: Developing efficiency of 90% or greater

○: Developing efficiency of 80% to less than 90%

Δ: Developing efficiency of 70% to less than 80%

X: Developing efficiency of 60% to less than 70%

Transferability (Primary and Secondary)

Primary transferability was evaluated using a ratio of the weight of the toner per unit area of the intermediate transfer member after transferring the toner to the intermediate transfer member from the electrophotographic photoreceptor to the weight of the toner per unit area of the electrophotographic photoreceptor, obtained through evaluation of developing property described above. In addition, secondary transferability was evaluated using a ratio of the weight of the toner per unit area on printing paper after the toner was transferred to the printing paper to the weight of the toner per unit area of the intermediate transfer member. In this regard, to evaluate transferability, the weight of the toner per unit area on printing paper was measured using an unfixed image.

Primary transferability=Weight of toner per unit area of intermediate transfer member/weight of toner per unit area of electrophotographic photoreceptor×100 (%)

Secondary transferability=Weight of toner per unit area of paper/weight of toner per unit area of intermediate transfer member×100 (%)

Transferability=Primary transferability×Secondary transferability.

Transferability of the toners was evaluated according to the following criteria.

◎: Transferability of 90% or greater

○: Transferability of 80% to less than 90%

Δ: Transferability of 70% to less than 80%

X: Transferability of 60% to less than 70%

Photoreceptor Background Contamination

After printing images on 1,000 sheets of paper, a non-image area on a photoreceptor drum (i.e., electrophotographic photoreceptor) was taped. Optical densities at the three locations were measured and an average thereof was calculated. The optical density was measured using "Electroeye" Reflection Densitometer. Performance of preventing photoreceptor background contamination was evaluated according to the following criteria.

◎: Optical density of less than 0.03 (indicating excellent performance of preventing photoreceptor background contamination)

○: Optical density of 0.03 to less than 0.05 (indicating performance of preventing photoreceptor background contamination)

Δ: Optical density of 0.05 to less than 0.07 (indicating poor performance of preventing photoreceptor background contamination)

X: Optical density of 0.07 or greater (indicating very poor performance of preventing photoreceptor background contamination)

Developing Durability (Time-Dependent Charge)

Images were printed up to 5,000 sheets of paper and image densities over time were measured at every print of 1,000 sheets to evaluate degrees of changes in comparison with initial state were as the number of prints increases. Measurement results were classified according to the following criteria.

◎: Less than 10% change in image density after printing 5,000 sheets when compared to initial state (indicating excellent developing durability of toner)

○: 10% to less than 20% change in image density after printing 5,000 sheets when compared to initial state (indicating good developing durability of toner)

Δ: 20% to less than 30% change in image density after printing 5,000 sheets when compared to initial state (indicating poor developing durability of toner)

X: 40% or more change in image density after printing 5,000 sheets when compared to initial state (indicating very poor developing durability of toner)

Referring to Table 3, it can be confirmed that the toners prepared according to Examples 1 to 7 having the [La] XRF intensity, the [Sr] XRF intensity, the [La]/[Si] XRF intensity ratio, and the [Sr]/[Si] XRF intensity ratio satisfying all of conditions (1), (2), (3), and (4) have excellent environmental charging stability, developing properties, transferability, and developing durability and low photoreceptor background contamination.

INDUSTRIAL APPLICABILITY

Accordingly, according to the present disclosure, the toner for developing an electrostatic latent image having excellent fusability, fluidity, transferability, charging stability, and developing properties and effectively inhibiting photoreceptor background contamination may be obtained.

It should be understood that the examples described herein should be considered in a descriptive sense only and not for purposes of limitation. Descriptions of features within each example should typically be considered as available for other similar features in other examples.

While one or more examples have been described, it will be understood by those of ordinary skill in the art that various changes in form and details may be made therein without departing from the spirit and scope as defined by the following claims.

The invention claimed is:

1. A toner for developing an electrostatic latent image, the toner comprising a plurality of toner particles, wherein each toner particle of the plurality of toner particles comprises:

a particle including a binder resin, a colorant, and a releasing agent; and an additive attached to a surface of the particle, the additive including silica particles and lanthanum strontium titanate particles, such that, when the plurality of toner particles are measured by X-ray fluorescence (XRF) spectrometry, an X-ray fluorescence intensity of lanthanum [La] (unit: kcps) and an X-ray fluorescence intensity of strontium [Sr] (unit: kcps) measured by the XRF spectrometry of the plurality of toner particles satisfy following conditions (1) and (2) below:

$$0.2\ \text{kcps} < [La] < 2\ \text{kcps} \quad (1), \text{ and}$$

$$100\ \text{kcps} < [Sr] < 800\ \text{kcps} \quad (2).$$

2. The toner of claim 1, wherein, when the plurality of toner particles are measured by the X-ray fluorescence (XRF) spectrometry, the X-ray fluorescence intensity of lanthanum [La] of the toner (unit: kcps), the X-ray fluorescence intensity of strontium [Sr] of the toner (unit: kcps), and an X-ray fluorescence intensity of silicon [Si] (unit: kcps) of the plurality of toner particles measured by XRF spectrometry satisfy following conditions (3) and (4) below:

$$0.01 \leq [La]/[Si] \leq 0.04 \quad (3),$$

$$1 \leq [Sr]/[Si] \leq 20 \quad (4).$$

3. A toner supply device couplable to an image forming apparatus, the toner supply device to supply the toner according to claim 2.

4. An image forming apparatus to form an image to form an image by supplying the toner according to claim 2.

5. The toner of claim 1, wherein the silica particles include large-diameter silica particles having a volume average particle diameter D50 of about 50 nm to about 300 nm, and small-diameter silica particles having a volume average particle diameter D50 of about 5 nm to less than 50 nm, wherein a volume average particle diameter D50 is a diameter at which a cumulative volume of the silica particles corresponds to 50% of a total cumulative volume of the silica particles in a cumulative volume curve of the silica particles.

6. A toner supply device couplable to an image forming apparatus, the toner supply device to supply the toner according to claim 5.

7. An image forming apparatus to form an image to form an image by supplying the toner according to claim 5.

8. The toner of claim 1, wherein the lanthanum strontium titanate particles have a volume average particle diameter D50 of about 20 nm to about 100 nm, wherein a volume average particle diameter D50 is a diameter at which a cumulative volume of the lanthanum strontium titanate particles corresponds to 50% of a total cumulative volume of the lanthanum strontium titanate particles in a cumulative volume curve of the lanthanum strontium titanate particles.

9. A toner supply device couplable to an image forming apparatus, the toner supply device to supply the toner according to claim 8.

10. An image forming apparatus to form an image to form an image by supplying the toner according to claim 8.

11. A toner supply device couplable to an image forming apparatus, the toner supply device to supply the toner according to claim 1.

12. The toner supply device of claim 11, comprising:

a toner tank to store the toner;

a supplying part protruding toward an inner side of the toner tank and supplying the stored toner to an outside of the toner tank; and a toner stirring member rotatably installed inside the toner tank, the toner stirring member to stir the toner in at least a portion of an inner space of the toner tank including an upper portion of the supplying part.

13. An image forming apparatus to form an image by supplying the toner according to claim 1.

14. The image forming apparatus of claim 13, comprising:

an image carrier;

an image forming device to form an electrostatic latent image on a surface of the image carrier;

a toner storage to store the toner;

a toner supply device to supply the toner to the surface of the image carrier to thereby develop the electrostatic latent image on the surface of the image carrier as a visible image on the surface of the image carrier; and a transferring device to transfer the visible image from the surface of the image carrier to an image receiving member.

* * * * *